United States Patent [19]

Ogawa

[11] 4,163,226

[45] Jul. 31, 1979

[54] ALARM CONDITION DETECTING APPARATUS AND METHOD

[75] Inventor: Francis T. Ogawa, Lakewood, Colo.

[73] Assignee: Statitrol Division Emerson Electric Co., Lakewood, Colo.

[21] Appl. No.: 830,326

[22] Filed: Sep. 2, 1977

[51] Int. Cl.[2] ..... G08B 17/10

[52] U.S. Cl. ..... 340/629; 250/381; 340/506

[58] Field of Search ..... 340/237 S, 409, 629, 340/506; 250/381, 382, 384

[56] References Cited

U.S. PATENT DOCUMENTS

| | | | |
|---|---|---|---|
| 3,801,972 | 4/1974 | Ho Kim et al. | 340/237 S X |
| 3,906,474 | 9/1975 | Lehsten | 250/384 X |
| 4,017,852 | 4/1977 | Kabat | 340/237 S X |

*Primary Examiner*—John W. Caldwell, Sr.
*Assistant Examiner*—Daniel Myer
*Attorney, Agent, or Firm*—Max L. Wymore

[57] ABSTRACT

Alarm condition detecting apparatus in the form of a combustion products detection system for monitoring a zone to detect the occurrence of fire therein. The apparatus has a plurality of detecting units adapted to be interconnected as parallel loads with a control unit. Each detecting unit receives operating power which may be from the control unit and functions to monitor a selected portion of the zone, generating, as appropriate, condition signals indicative of condition normal, impending alarm, alarm or unit malfunction. The impending alarm and unit malfunction signals are preferably pulsed signals of distinctly different frequencies and a light emitting diode (LED) arrangement is included in the detecting units to generate visual ouputs corresponding to the impending alarm, alarm and unit malfunction signals. The condition signals generated by the detecting units may be transmitted to and monitored by the control unit by the method of correspondingly changing the parallel load impedance thereacross to cause changes in a loop current flowing in the control unit. In response to such loop current changes, the control unit is adapted to appropriately indicate that the zone is in a normal state, an impending alarm condition, an alarm state, detecting unit malfunction or system trouble. To indicate alarm condition, the control unit latches in an alarm output state. The control unit has time delay circuitry to prevent latching into the alarm output state until an alarm condition signal of predetermined duration has been received.

22 Claims, 3 Drawing Figures

ALARM CONDITION DETECTING APPARATUS AND METHOD

BACKGROUND OF THE INVENTION

The present invention relates to the detection of the occurrence of alarm conditions, such as the conditions associated with the occurrence of fire.

SUMMARY OF THE INVENTION

It is an object of the present invention to provide an improved apparatus for detecting the approach and occurrence in a selected zone of an alarm condition, such as fire.

It is also an object of the present invention to provide an improved alarm condition detecting apparatus as set forth capable of monitoring the selected zone by use of a plurality of detecting units supervised by a control unit.

It is additionally an object of the present invention to provide an improved alarm condition detecting apparatus as set forth capable of indicating unit malfunction and/or system trouble.

It is another object of the present invention to provide an improved method for detecting the approach and occurrence of an alarm condition, such as fire.

In accomplishing these and other objects, there is provided in accordance with the present invention apparatus for detecting the occurrence of an alarm condition. The apparatus is illustrated in the form of a smoke or combustion products detection system for detecting the occurrence of fire in a selected zone.

The apparatus illustrated has a plurality of smoke detecting units each appropriately positioned to monitor a selected portion of the zone and each of the smoke detecting units operates to generate a first voltage proportional to the degree of smoke or combustion products in the atmosphere being monitored and to combine same with a second or reference voltage to produce a difference signal. The level of the second voltage is adjustable and is appropriately set when the atmosphere being monitored is in a clear or normal state and power supply voltage level is normal to establish a reference level for the difference signal.

In the apparatus, the plurality of smoke detecting units are connected as parallel loads with the control unit. Each smoke detecting unit receives operating power from the control unit and functions to monitor a selected portion of the zone, generating in response to and as a function of the difference signal it produces zone condition signals indicative of condition normal, impending alarm, alarm and unit insensitivity or malfunction.

The impending alarm and unit malfunction signals are each fault signals indicating that the degree of the condition being detected has deviated from a normal range, respectively, in opposite senses, and these signals are preferably pulsed signals of distinctly different frequencies. A light emitting diode (LED) arrangement is included in the smoke detecting units to generate visual outputs corresponding to the impending alarm, alarm and unit malfunction signals.

The zone condition signals generated by the smoke detecting units are transmitted to and monitored by the control unit by the method of correspondingly changing the parallel load impedance thereacross to cause changes in a loop current flowing in the control unit. In response to such loop current changes, the control unit operates to appropriately indicate that the zone is in a normal state, an impending alarm fault condition, an alarm state, detecting unit malfunction or system trouble. To indicate alarm condition, the control unit latches in an alarm output state. The control unit has time delay circuitry to prevent latching into the alarm output state until an alarm condition signal of predetermined duration has been received.

Additional objects of the present invention resides in the specific construction of the exemplary combustion products detection system hereinafter described in detail in conjunction with the several drawing figures, as well as its method of operation.

DETAILED DESCRIPTION OF THE PREFERRED EMBODIMENT

Figure 1:
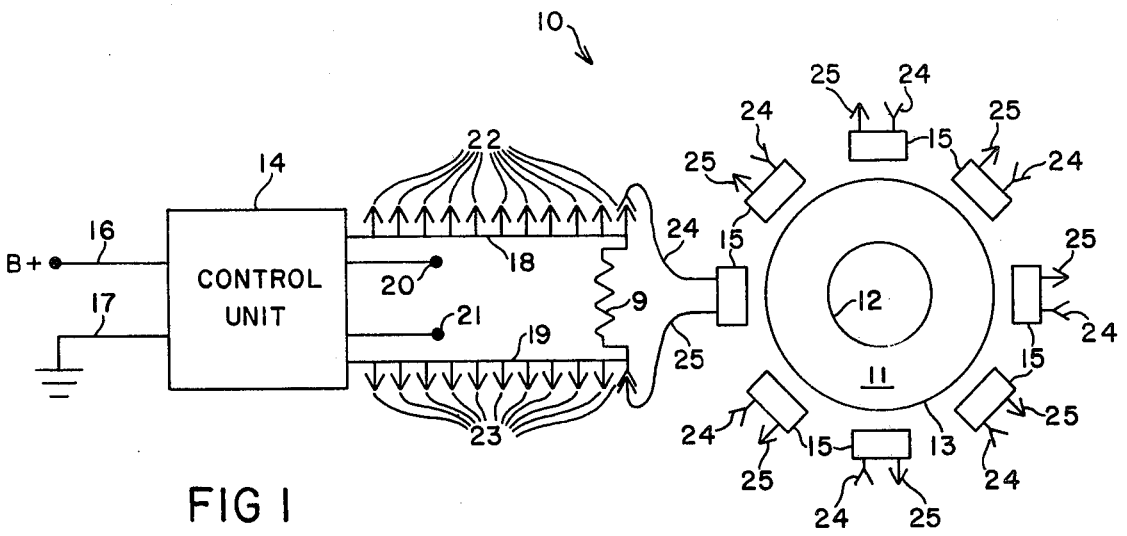
FIG. 1 is a block diagram of a combustion products detection system according to the present invention made up of a plurality of smoke detecting units supervised by a central control unit.
Figure 2:
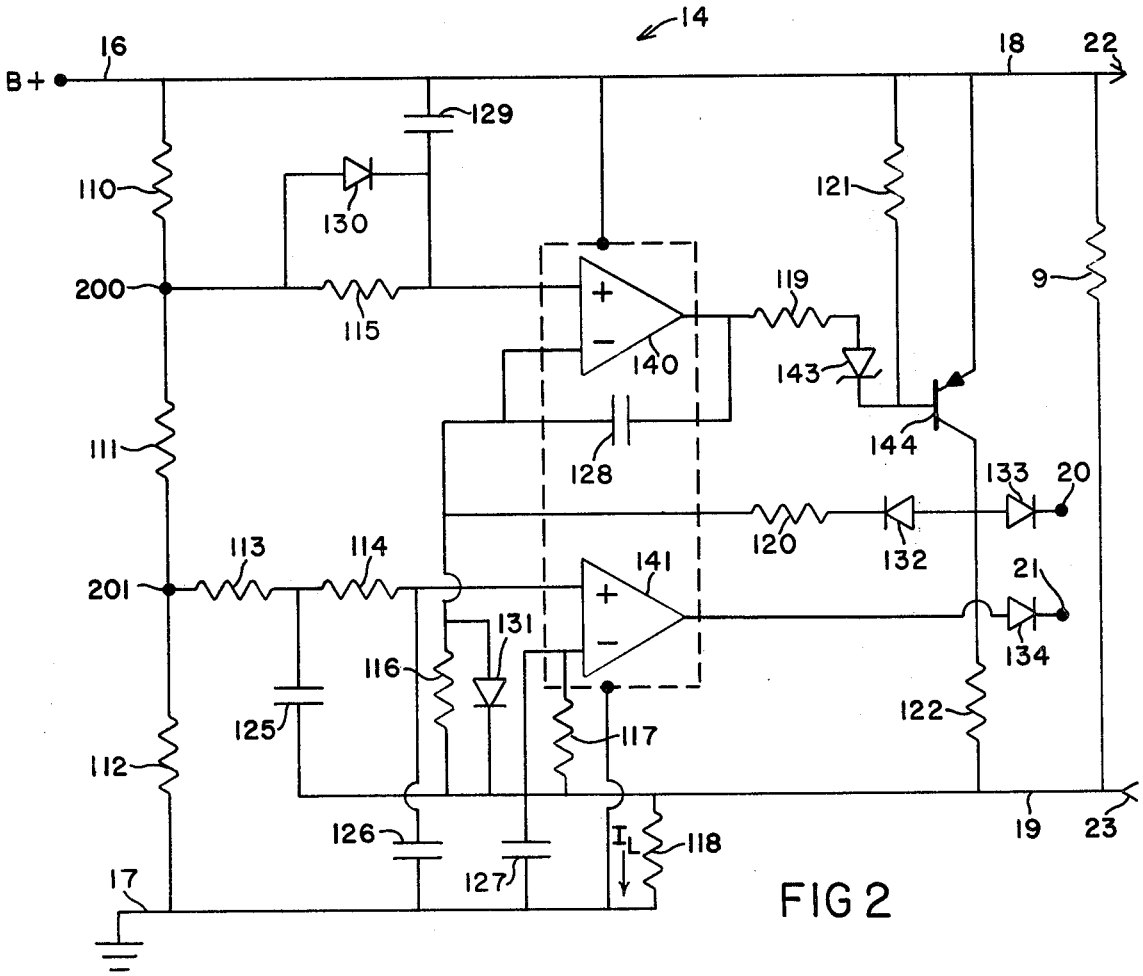
FIG. 2 is a circuit diagram of the control unit of FIG. 1.

Referring to the drawings in more detail, there is shown in FIG. 1 an alarm condition detecting apparatus in the form of a combustion products detection system 10 for detecting fire. For purposes of illustration, the system 10 is shown supervising a ring-shaped zone 11 defined by cylindrical walls 12 and 13.

The system 10 is made up of a central control unit 14 and a plurality of smoke and combustion products detecting units 15. The number of detecting units 15 shown is eight, although more or less could be employed as needed to monitor the zone 11.

The control unit 14 has power supply input terminals 16, 17; voltage buses 18, 19. B+ voltage, which is preferably +24 volts DC, is connected to terminal 16 while terminal 17 is grounded. As hereinafter explained, the buses 18 and 19 carry terminals across which leads from the plurality of smoke detecting units 15 are connected. The output terminals 20, 21 provide terminals upon which alarm and trouble signals, respectively, are outputted. End of line (EOL) resistor 9 is connected across the ends of the buses 18 and 19.

The buses 18 and 19 are illustrated carrying a plurality of terminals 22 and 23 designed, respectively, for being coupled with leads 24 and 25 of the smoke detecting units 15. The leads 24, 25 of one of the smoke detecting units 15 is illustrated connected to the buses 18, 19, respectively. The leads 24, 25 of the other units 15 are similarly coupled to the buses 18, 19; however, in order to simplify FIG. 1, the connection of the other leads 24, 25 is not specifically shown. The detecting units 15 when connected between the buses 18, 19 are connected as loads in parallel with the EOL resistor 9.

Figure 3:
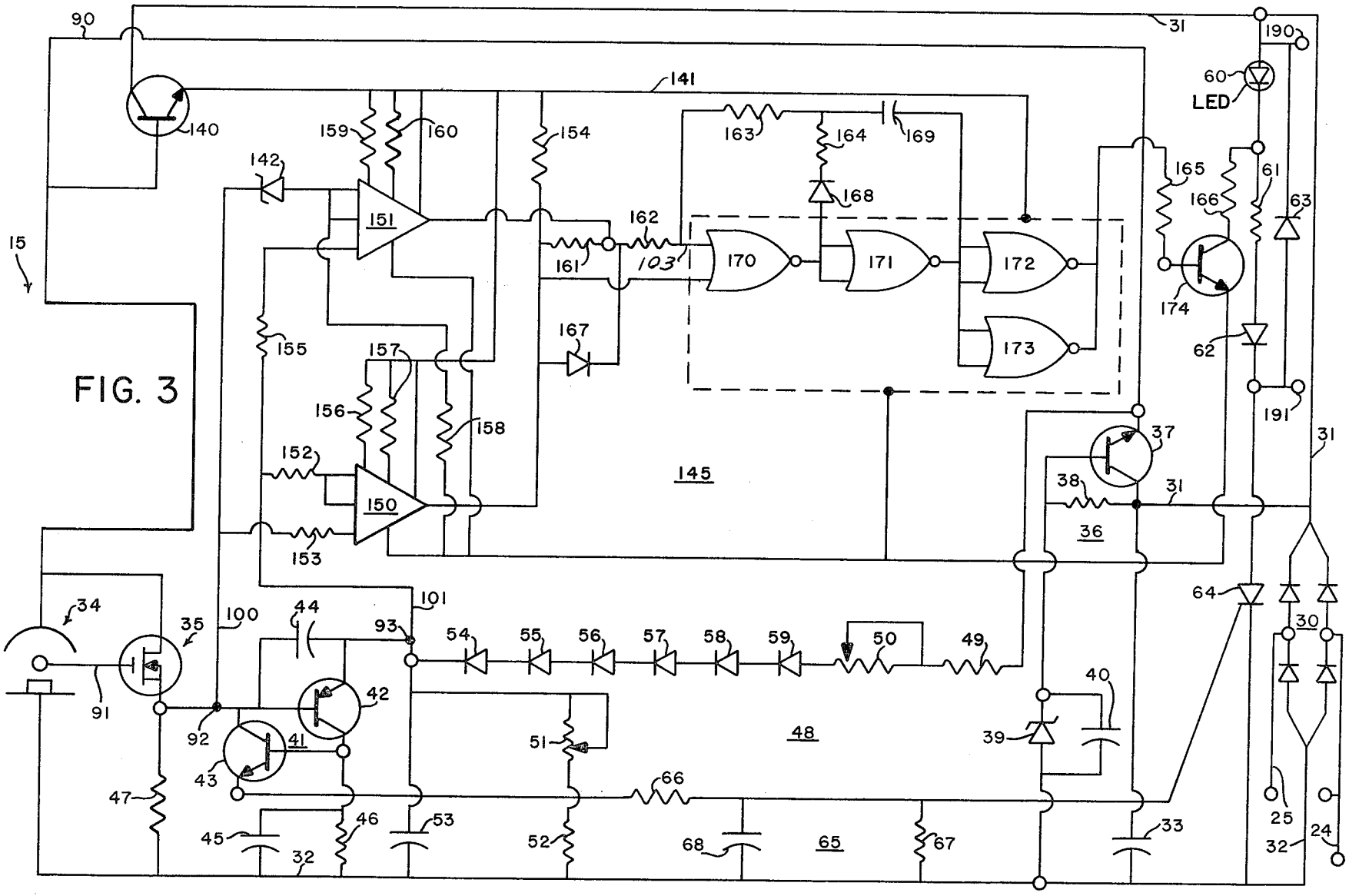
FIG. 3 is a circuit diagram of one of the smoke detecting units of FIG. 1.

Referring now to FIG. 3, the circuit of and associated with one of the smoke detecting units 15 is there shown. Power, in the form of B+ voltage and ground, is supplied to the unit 15 from the control unit 14 on leads 24 and 25. With the detecting unit 15 connected as indicated in FIG. 1, the +24 VDC B+ voltage is applied to lead 24 while ground is applied to lead 25. It is noted, however, that the diode bridge 30 acts as a polarity protection device which operates to transmit the B+ voltage to voltage bus 31 and ground to voltage bus 32 regardless of whether the B+, ground voltages are applied to leads 24, 25 or vice versa. The capacitor 33 operates as a filter capacitor to provide a smooth DC signal across the leads 31 and 32.

The smoke detecting unit 15 includes an ion chamber 34; field effect transistor (FET) 35 with associated load resistor 47; voltage regulator circuit 36 made up of NPN transistor 37, resistor 38, zener diode 39 and capacitor 40; an oscillator circuit 41 made up PNP transistor 42, NPN transistor 43, capacitors 44, 45 and resistor 46; a voltage divider circuit 48 made of resistors 49–52, capacitor 53, and diodes 54–59; an indicator circuit made up of a light emitting diode (LED) 60, resistor 61, diodes 62, 63, and silicon controlled rectified (SCR) 64; SCR latching circuitry 65 made up of resistors 66, 67 and capacitor 68; and a difference signal monitoring circuit 145.

The difference signal monitoring circuit 145, the operation of which is hereinafter described, is made of a transistor 140 connected to supply regulated voltage to voltage bus 141; operational amplifiers 150, 151; zener diode 142; resistors 152–166; diodes 167, 168; capacitor 169; NOR gates 170–173; and, NPN transistor 174.

In the unit 15, the voltage applied to bus 90, and hence across the ion chamber 34, FET 35 and voltage divider circuit 48, is set and regulated by the regulator circuit 36 to be at a predetermined level less than the DC potential difference between buses 31 and 32. For example, with the bus 31 at +24 VDC, the voltage regulator circuit 36 may be selected to set the bus 90 at +10 VDC.

During operation of the smoke detecting unit 15, the ion chamber 34, which may use as a radiation source Americium 241, operates to control electrical current flow therethrough as a function of the clarity of the air or atmosphere being monitored therein. When the atmosphere is in a clear state, i.e. zero or negligible combustion products present, the current flow through the ion chamber is maximum and the voltage signal generated on ion chamber output terminal 91 is at a so-called normal level. Upon the occurrence of fire in the portion of the zone 11 being monitored by the detector 15, smoke and combustion products will commence to fill the air being monitored, thereby increasing the electrical resistance of the ion chamber 34 to current flow therethrough. As a consequence, the ion chamber output voltage generated on terminal 91 proportionally decreases from its normal clear state level as the degree of combustion products present in the atmosphere being monitored increases.

The FET 35 is connected as a voltage follower and receives the ion chamber output signal on its gate electrode. In response to the ion chamber output signal received, the FET 34 operates to generate across its load resistor 47 on circuit point 92 as a condition signal a voltage directly proportional to the ion chamber output signal. It is noted that the magnitude of the condition signal generated on point 92 varies inversely as the degree of the condition being monitored approaches alarm state, that is to say, as the level of smoke and combustion products in the atmosphere being monitored increases, the magnitude of the condition voltage decreases by approaching the ground voltage level on bus 32.

In the unit 15 a reference signal in the form of a DC voltage is generated on circuit point 93 by the voltage divider network 48 formed by resistors 49–52. The resistors 50 and 51 are both variable resistors. By adjusting the resistance of either of these resistors, the magnitude of the DC reference voltage appearing on circuit point 93 may be selectively controlled and set. The magnitude of the variable resistor 51 is substantially larger than that of variable resistor 50. The setting of the resistor 51 is generally set at the factory and this control is termed the compensation control. The variable resistor 50 serves as a fine adjustment or sensitivity control for controlling the level of the reference voltage on circuit point 93.

The difference signal generated across circuit points 92 and 93 is transmitted by leads 100 and 101 as a differential input to both of the operational amplifiers 150 and 151.

Under normal conditions, when the atmosphere being monitored is clear and there is no malfunction of the units 14 or 15, the condition voltage on lead 100 is higher than the voltage on lead 101 by a preset amount, which is initially established by the setting of the voltage divider network provided by resistors 49–52. This preset amount is preferably one volt DC, that is to say the voltage on lead 101 is set to be approximately one VDC lower than the condition signal on lead 100 under normal conditions. Thus, under normal conditions the differential input to operational amplifier 150 is one VDC of a predetermined sense.

With regard to the operational amplifier 151, the zener diode 142 functions to drop the voltage input thereto from lead 100 by a selected amount, such as 1.8 VDC, to set a differential input of selected amount, i.e. 0.8 VDC, and opposite polarity thereon under normal conditions, i.e. −0.8. In this manner, as hereinafter explained, a 1.8 VDC normal or standby operating range is set for the unit 15.

With these preset differential inputs applied to the operational amplifiers 150 and 151, both amplifiers generate a logic HIGH output. This logic HIGH is transmitted to both inputs of the NOR gate 170 with the result that gate 170 outputs a logic LOW, and as a consequence, the diode 168 decouples the junction of resistors 163, 164 and capacitor 169 from the output of the gate 170. NOR gate 171 converts the LOW output of gate 170 into a logic HIGH output, and this logic HIGH output of gate 171 is in turn converted by the parallel connected NOR gates 172 and 173 into a logic LOW which biases the collector-emitter path of the NPN transistor 174 in a non-conductive state. With the collector-emitter path of transistor 174 biased in a non-conductive state, the LED 60 is off since the SCR 64 under normal operating conditions is also biased off.

As smoke and combustion products enter the atmosphere being monitored by the detecting unit 15, the voltage on lead 100 decreases and the difference between the voltage on lead 100 approaches that on lead 101 until the voltage on lead 100 becomes equal to or slightly less than that on lead 101. The difference signal between circuit points 92 and 93 has now reached an impending alarm level and the output of the operational amplifier 150 switches to a logic LOW state. As a consequence, the existing HIGH on the output of gate 171 causes the capacitor 169 to charge through resistors 161, 162 and 163 until the voltage on the input 103 of the NOR gate 170 drops below gate threshold.

Upon the input 103 dropping below gate threshold, the output of gate 170 goes HIGH, the output of gate 171 in turn goes LOW, and the parallel outputs of gates 172 and 173 go HIGH whereby to bias the emitter-collector path of the transistor 174 into conduction and turn the LED 60 on. The switch of the output of gate 171 from HIGH to LOW causes the capacitor 169 to be charged in the opposite direction through the charging path defined by resistor 164 and diode 168 due to the HIGH now present on the output of gate 170. As a consequence of this reverse charging of the capacitor 169, the voltage on the input 103 of gate 170 increases until the gate threshold voltage is exceeded. When the voltage at input 103 exceeds the threshold voltage of the gate 170, the output of gate 170 goes LOW, the output of gate 171 goes HIGH and the outputs of gates 172 and 173 go LOW whereby to bias the emitter-collector path of the transistor 174 off and turn the LED 60 off. In this manner and until alarm condition is reached, the difference voltage monitoring circuit 145 operates to cycle the LED 60 on and off at a predetermined frequency as long as the difference signal between circuit points 92 and 93 is at or beyond its impending alarm level, thereby to indicate the approach of an alarm condition.

It is noted that during the impending alarm condition the on-time of the LED 60 is determined by the time constant provided by the capacitor 169 and resistor 164 and its off-time is set by the time constant provided by the capacitor 169, resistor 161, 162 and 163.

As aforementioned, the impending alarm level is reached when smoke and combustion products in the atmosphere being monitored by the ion chamber 34 cause the condition voltage on circuit point 92 and lead 100 to become equal to or slightly less than the reference voltage on lead 101. As now explained, if the smoke and combustion products in the atmosphere being monitored by the ion chamber 34 continue to increase, an alarm state will be reached and the unit 15 will switch from outputting an impending alarm condition signal to outputting an alarm condition signal.

An alarm condition occurs when the smoke and combustion products in the atmosphere within the ion chamber 34 causes the condition voltage on lead 100 to drop a predetermined amount below the voltage on lead 101, such 0.5 VDC below. Upon such occurrence, the oscillator circuit 41 is triggered into oscillation and transmits a series of pulses via the SCR latching circuit 65 to the gate of the SCR 64. As a consequence, the SCR 64 is latched on to turn the LED 60 on and a step increase in the loop current of the control 14 occurs, as is hereinafter explained. The turned on LED 60 provides a visual indication that the unit 15 is detecting an alarm condition.

It is noted that when the oscillator circuit 41 stops oscillating that the SCR 64 remains in its conductive state. It is also noted that an auxiliary indicating device may be connected in parallel with the LED 60 by connecting such device between terminals 190 and 191.

Upon the occurrence in the detecting unit 15 or control unit 14 of a malfunction causing the difference between the voltages on leads 100 and 101 to increase to a given level, i.e. 1.8 volts, indicative of unit insensitivity, the output of operational amplifier 151 switches from a logic HIGH to a logic LOW. As a consequence, the junction of resistors 161 and 162 is grounded and the capacitor 169 charges through the charging path defined by resistors 162, 163 and capacitor 169 between the outputs of the gate 171 and amplifier 151. As earlier described, the capacitor 169 so charges until the voltage on the input 103 of the gate 170 drops below gate threshold. The gate 170 output then goes HIGH with the result that the LED 60 is turned on in the manner aforedescribed and the direction of charging the capacitor 169 is reversed. In this manner, the difference voltage monitoring circuit 145 operates to cycle the LED 60 on and off at a second frequency as long as the difference signal between circuit points 92 and 93 is at or beyond its unit malfunction level, thereby to indicate the fault of detection insensitivity of the unit 15.

It is noted that during the detection of malfunction the on-time of the LED 60 is determined by the time constant provided by the capacitor 169 and resistor 164, as during the impending alarm condition. The off-time of the LED 60 during the detection of malfunction is shorter than during the detection of an impending alarm condition, however, due to the deletion of resistor 161 from the capacitor charging path. Hence, the second frequency at which the LED 60 is pulsed on during malfunction is higher than the frequency at which it is pulsed on during the impending alarm condition. In an apparatus constructed in accordance with the present invention, a frequency of 0.5–1 Hertz of the LED 60 was used to indicate impending alarm while a frequency of 1.5–2 Hertz was employed to indicate unit insensitivity malfunction, thereby to provide a perceptible difference between impending alarm and malfunction signals.

In summary, the states of the detecting unit 15 may be categorized in the following manner. Firstly, there is the standby or normal condition of the unit 15. The unit 15 is in its normal condition when the difference signal between leads 100 and 101 is in the predetermined 1.8 volt range heretofore mentioned. In normal condition, the LED 60 is biased off and the unit 15 presents a relatively high constant impedance load to the control unit 14.

It is here noted that the value of the EOL resistor 9 terminating and interconnecting the voltage buses 18, 19 is selected such that the total parallel current drain through the units 15, which are connected as loads in parallel with EOL resistor 9, is negligible under normal conditions. For example, under normal conditions the total current through the smoke detecting units 15 may be 1 milliampere while the current flow through the EOL resistor 9 may be 12 milliamperes. Thus, it may be said that when the zone 11 is in normal condition, the parallel load connected between the two wire bus arrangement 18, 19 is substantially constant and essentially defined by the magnitude of the EOL resistor 9. As hereinafter explained, the magnitude of the load between buses 18, 19 is utilized to control the magnitude of a loop current $I_L$ flowing in the control unit 15 and the magnitude of this loop current $I_L$ is in turn employed to control the outputting of impending alarm, alarm, unit malfunction and trouble outputs from the control unit 14.

Continuing now with a categorization of the states of the unit 15, its second condition is impending alarm fault condition. In the impending alarm state, the voltage on lead 100 has become equal to or slightly less than the voltage on lead 101. This condition is called impending alarm since accumulation of combustion products in the ion chamber 34 causes the voltage on lead 100 to so drop, but it is noted that it is possible that a malfunction of the unit 15 could also cause the voltage on lead 100 to become equal to or slightly less than the voltage lead 101. In such instance, an impending alarm signal would then be indicative of unit malfunction.

In its impending alarm condition, the unit 15 operates to flash the LED 60 on and off at the rate 0.5–1.0 Hertz.

As earlier mentioned, the on-time of each pulse of the LED 60 is of uniform duration and may be 20 milliseconds. With regard to the load between the buses 18, 19, the turning on of the LED 60 has the effect of substantially placing short circuit therebetween. Hence, in its impending alarm condition, the control unit 15 sees in effect across its two wire bus arrangement 18, 19, a pulsating load which varies at the rate 0.5–1.0 Hertz between a load substantially equal to the magnitude of the EOL resistor 9 and a short circuit.

A third state of the unit 15 is a malfunction or unit insensitivity fault condition. In this state, the voltage on lead 101 has decreased to become a predetermined amount less than the voltage on lead 100, i.e. 1.8 VDC less. Such a voltage change is indicative of malfunction and insensitivity of the unit 15. Consequently, this condition is called a fault or malfunction. In the malfunction condition, the unit 15 operates to flash the LED 60 on and off at the rate 1.5–2.0 Hertz, the on pulses of the LED 60 being of the same uniform duration as those of the impending alarm condition signal. With regard to the load between the buses 18, 19, the turning on of the LED 60 has the same effect thereon heretofore described with relation to the impending alarm condition of the unit 15. Thus, in its malfunction condition, the control unit 15 sees in effect across its two wire bus arrangement 18, 19, a pulsating load which varies at the rate of 1.5–2.0 Hertz between a load substantially equal to the magnitude of the EOL resistor 9 and a short circuit.

The fourth state of the smoke detecting unit 15 is its alarm condition. Such occurs when the voltage on lead 100 drops a predetermined amount below the voltage on lead 101, i.e. 0.5 volts below. In alarm condition, the SCR 64 is latched on to bias on the LED 60 and place an effective short circuit or low impedance load across the two wire bus arrangement 18, 19 of the control unit 14.

With power applied to the system 10 and allowed to stabilize, a fixed loop current $I_L$ flows under zone normal conditions through the loop defined by the bus 18, parallel load between the bus 18 and 19, the bus 19 and zone current monitoring resistor 118. As aforementioned, under these conditions the load between the buses 18 and 19 is effectively defined by the EOL resistor 9. The normal or standby loop current $I_L$ may be on the order of 12 milliamperes.

Under such normal operating conditions, the voltage across resistor 118 due to the constant loop current $I_L$ is greater than the voltage at node 201, the trouble set point, but less than the voltage at node 200, the alarm set point. Consequently, the output of the comparator 140 is a logic HIGH and biases the collector-emitter path of the transistor 144 in a nonconductive state, while the output of the comparator 141 is a logic LOW. Thus, in standby or normal condition, LOWs appear on both output terminals 20 and 21.

When one of the detectors 15 connected across the two wire bus arrangement 18, 19 goes into an alarm state, a short circuit or low impedance is effectively placed across the buses 18 and 19 which cause the loop current $I_L$ to increase to a constant current of a predetermined higher level, such as in excess of 18 milliamperes. This increase in the loop current $I_L$ causes the voltage generated across the resistor 118 to exceed the alarm set voltage at node 200. As a consequence, the output of amplifier 140 ramps negative with a slope that is a function of the time constant provided by resistor 116 and capacitor 128. As the output of amplifier 140 goes negative a point is reached where the output drops below the turn-on voltage of zener diode 143, and as a consequence, the emitter-collector current path of the transistor 144 is biased into conduction. The conduction of the transistor 144 causes a voltage to be generated across resistor 122 and the voltage signal thus generated across resistor 122 is outputted as an alarm output or HIGH on terminal 20 through decoupling diode 133. Thus, in alarm condition, a HIGH is outputted on terminal 20 and a LOW on terminal 21.

It is noted that the feedback path provided by diode 132 and resistor 120 functions to latch the control unit 14 in this alarm condition. The control unit 14 may be unlatched from alarm state by turning off its power.

As a consequence of this latching provision it is important to have a predetermined delay, such as several seconds, built in the control unit 14 to prevent the control unit from latching on a noise pulse from one of the detecting units 15. This delay is accomplished by the aforementioned differential integration provided by the amplifier 140, resistor 116 and capacitor 128 as well as the zener threshold provision provided by the zener diode 143, which requires the output of amplifier 140 to decrease sufficiently to overcome zener threshold before the transistor 144 conducts. Diode 131 prevents capacitor 128 from storing up charges due to current pulses indicating fault, which are hereinafter discussed, by discharging capacitor 128 each time current pulses appearing on lead 19 return to zero.

It is also noted that capacitor 129, resistor 115 and diode 130 are provided to prevent false alarms during power turn on of the apparatus 10 or during power interruptions and fluctuations. When power first comes on, the output of amplifier 140 must be forced HIGH to prevent the collector-emitter current path of transistor 144 from conducting. This is accomplished during power turn on by the capacitor 129 which pulls the non-inverting input of amplifier 140 HIGH and which charges through resistors 111, 112 and 115. During power interruption or fluctuations, the diode 130 conducts keeping the non-inverting input of amplifier 140 HIGH, also to prevent false alarm.

If a break occurs anywhere along the two wire bus 18, 19 or trouble occurs causing the loop current $I_L$ to drop below a certain level, such as 5 milliamperes, the voltage across resistor 118 generated by the loop current $I_L$ drops below the trouble voltage set point on node 201. Accordingly, the output of the comparator 141 goes HIGH and a HIGH is outputted as a trouble output on terminal 21. Thus, in trouble condition, a HIGH is outputted on terminal 21 and a LOW on terminal 20.

In the event one of the detecting units 15 goes into a fault state as a consequence of the difference signal dropping or increasing out of the present range hereinbefore discussed, whether the fault be due to an impending alarm condition or unit insensitivity, a pulsating load impedance is created across the buses 18 and 19 which causes the loop current $I_L$ to be similarly pulsed. The loop current pulses $I_L$ so generated have a selected magnitude and duration, such as greater than 18 milliamperes and 20 milliseconds in duration, and operate to generate voltage pulses across the resistor 118 which are coupled to the non-inverting input of the amplifier 141 through capacitor 125 and resistor 114. The capacitor 126 functions to decouple any spikes which are transmitted through capacitor 125 and the capacitor 127 decouples the current pulses from the inverting input of amplifier 141.

The current pulses across resistor 118 caused by the flashing of the LED 60 at either the 0.5–1 Hertz or 1.5–2 Hertz frequency rates are large enough to enable the control unit 14 by causing the non-inverting input of the amplifier 141 to exceed its inverting input. This occurs since the non-inverting input of the amplifier 141 is held at a normal supervision level by the voltage on capacitor 127 and due to the current pulses detected by resistor 118 which cause the voltage across resistor 118 to drop below the trouble reference voltage on circuit point 201. As a consequence, the output of amplifier 141 follows the current pulses coupled into its non-inverting input, going HIGH in time correspondence therewith, to generate a fault signal which is outputted through decoupling diode 134 on terminal 21 and which substantially follows the frequency at which the LED 60 is flashed in the detecting unit 15 indicating the impending alarm or unit insensitivity condition.

The only difference between a fault condition due to an impending alarm and a fault due to a drift away from alarm is the pulse rate 0.5–1.0 Hertz and 1.5–2.0 Hertz. Thus, in fault condition, a pulsed output is generated on terminal 21 and a LOW on terminal 20.

Although the invention has been herein shown and described in what is conceived to be the most practical and preferred embodiment, it is recognized that departures may be made therefrom within the scope of the present invention.

What is claimed is:

1. Apparatus for detecting the change of a selected condition from a normal to an alarm level, comprising:

at least one means for detecting the degree of the selected condition and generating a variable signal which is a function thereof, said condition detecting means including a pair of terminals through which operating power is received;

control means for supplying power to and supervising each of said condition detecting means, said control means including a two wire bus through which operating power is supplied to each of said condition detecting means;

a reference load connected across said two wire bus; and means for connecting each of said condition detecting means as loads across said two wire bus in parallel with said reference load, one of said pair of terminals of each of said condition detecting means being connected to one wire of said two wire bus and the other of said pair of terminals being connected to the other wire of said two wire bus; and, wherein:

each of said condition detecting means, when said variable signal is within a predetermined range indicative of condition normal, operates to produce a first impedance across said pair of terminals which appears as the condition normal load impedance of said condition detecting means across said two wire bus;

each of said condition detecting means, when said variable signal moves out of said predetermined normal range in a first sense indicative of increase of the degree of the selected condition towards an alarm state, operates to produce a second impedance across said pair of terminals which appears as the impending alarm load impedance of said condition detecting means across said two wire bus;

each of said condition detecting means, when said variable signal moves out of said predetermined normal range in said first sense by a predetermined amount exceeding the impending alarm level and indicative of the increase of the degree of the selected condition to an alarm state, operates to produce a third impedance across said pair of terminals which appears as the alarm load impedance of said condition detecting means across said two wire bus;

each of said condition detecting means, when said variable signal moves out of said predetermined normal range in a second sense opposite from said first sense, operates to produce a fourth impedance across said pair of terminals which appears as the detection insensitivity load impedance of said condition detecting means across said two wire bus;

said control means is responsive to the loading of said two wire bus produced by the appearance of said first, second and third impedances thereacross as a parallel load to indicate that the degree of the selected condition being detected is in a normal state, impending alarm state and alarm state, respectively; and, said control means is responsive to the change in loading of said two wire bus produced by the appearance of said fourth impedance thereacross as a parallel load to indicate that one of said condition detecting means has too low a sensitivity and is malfunctioning.

2. The invention defined in claim 1, including a plurality of said condition detecting means connected as parallel loads across said two wire bus, said condition detecting means being positioned to define and monitor a selected zone.

3. The invention defined in claim 1, wherein:

said first impedance has a fixed first magnitude;

said third impedance has a fixed second magnitude different from said first magnitude;

said second impedance is pulsating and varies at a first predetermined frequency between said first and second magnitudes;

said fourth impedance is also pulsating and varies at a second predetermined frequency between said first and second magnitudes, said second predetermined frequency being perceptibly different from said first predetermined frequency; and the magnitude of the impedance of said reference load is substantially lower than said first magnitude and substantially higher than said second magnitude.

4. The invention defined in claim 3, wherein said control means is operable to generate a loop current which flows through the parallel load defined between said two wire bus so that the changes in parallel load across said two wire bus caused by the appearance of said first, second, third and fourth impedances causes corresponding changes in said loop current, said control means being operable to indicate that the degree of the selected condition being detected is in a normal state, impending alarm state or alarm state or that said condition detecting means has too low a sensitivity all as a function of the magnitude of said loop current.

5. The invention defined in claim 4, wherein:

said loop current corresponding to said first impedance is a first level;

said loop current corresponding to said third impedance is a second level, said second current level being higher than said first current level;

said loop current corresponding to said second impedance is a pulsating current signal varying between said first and second current levels at said first predetermined frequency; and, said loop current corresponding to said fourth impedance is a pulsating current signal varying between said first and second current levels at said second predetermined frequency; and, including:

means responsive to said loop current at said second current level for generating after such current has been present for a predetermined period of time an alarm signal; and, means responsive to said loop current when pulsating and varying between said first and second current levels for generating correspondingly pulsating impending alarm and malfunction outputs.

6. The invention defined in claim 5, wherein said control means is operable to generate a trouble output whenever said loop current drops to an unsuitable level, said unsuitable level being predetermined and less than said first current level.

7. The invention defined in claim 6, wherein said means for generating alarm, impending alarm, malfunction and trouble outputs include means for generating from said loop current a voltage signal and voltage comparator means.

8. The invention defined in claim 3, wherein:

each of said condition detecting means includes a light emitting diode;

each of said condition detecting means is operable to flash said light emitting diode at said first predetermined frequency whenever said second impedance is being produced to visually indicate impending alarm condition;

each of said condition detecting means is operable to bias said light emitting diode on whenever said third impedance is being produced to visually indicate alarm condition; and, each of said condition detecting means is operable to flash said light emitting diode at said second predetermined frequency whenever said fourth impedance is being produced to visually indicate insensitivity of said condition detecting means.

9. The invention defined in claim 1, wherein said control means latches into an alarm state in response to said third impedance and includes delay means operable to delay the latching of said control means into an alarm state until said third impedance has appeared across said two wire bus for a predetermined period of time.

10. The invention defined in claim 1, wherein each of said condition detecting means includes:

means for sensing the degree of said condition and generating a first electrical signal having a magnitude proportional thereto;

means for generating a second electrical signal as a reference the magnitude of which is proportional to the level of power being received from said control means;

means for generating said variable signal as a function of said first and second electrical signals, said variable signal generating means being responsive to said first and second electrical signals to generate said variable signal as an electrical signal having a magnitude proportional to the difference in magnitudes of said first and second signals, said variable signal being within said predetermined range indicative of condition normal whenever the power received from said control means is at substantially normal level and the degree of the selected condition being detected is in a normal state, said variable signal changing in said first sense in response to changes occurring in the magnitude of said first electrical signal as a result of increase in the degree of the selected condition towards an alarm state and in said second sense whenever the sensitivity of said condition detecting means lessens;

oscillator means responsive to said variable signal for generating whenever said variable signal moves out of said predetermined normal range in said first sense a series of pulses at a first predetermined frequency to indicate impending alarm, said oscillator means also being operable to generate whenever said variable signal moves out of said predetermined normal range in said second sense a series of pulses at a second predetermined frequency to indicate insensitivity of said condition detecting means, said second predetermined frequency being perceptibly different than said first predetermined frequency;

light emitting diode means connected to be driven by said oscillator means at said first and second predetermined frequencies for providing visual indications of impending alarm and insensitivity of said condition detecting means; and, circuit means responsive to said variable signal for latching said light emitting diode means on whenever said variable signal moves out of said predetermined normal range in said first sense by a predetermined amount exceeding the impending alarm level and indicative of the increase of the selected condition to an alarm state to provide a visual indication of alarm.

11. The invention defined in claim 10, wherein said light emitting diode means in each of said condition detecting means functions to define the load of said condition detecting means across said two wire bus, said light emitting diode means when nonconductive having a relatively high impedance level and when conductive a relatively low impedance level.

12. The invention defined in claim 1, wherein:

said apparatus is for detecting the presence of smoke and combustion products in the atmosphere thereby to detect the occurrence of fire; and, each of said condition detecting means includes an ion chamber.

13. Apparatus for detecting the change of a selected condition from a normal to an alarm level, comprising:

a plurality of means for detecting the degree of the selected condition at points throughout a selected zone;

control means for supervising each of said condition detecting means, said control means having bus means for supplying operating power to each of said condition detecting means;

means connecting each of said condition detecting means across said bus means as parallel loads, each of said condition detecting means being operable to indicate whether the degree of the selected condition being detected is in a normal range, fault condition or alarm state by changes in its load impedance appearing across said bus means, said control means being operable in response to such changes in the parallel load appearing across said bus means to correspondingly indicate condition normal, fault occurrence or alarm state.

14. The invention defined in claim 13, wherein:

the load impedance of each of said condition detecting means appearing across said bus means varies in one manner to indicate the fault condition occurring when the degree of the selected condition being detected deviates from normal range in a first sense and varies in another different manner to indicate the fault condition occurring when the degree of the selected condition being detected deviates from normal range in a second sense opposite from said first sense, said first sense being indicative of the approach of said condition towards alarm level and said second sense being indicative of decrease of the detection sensitivity of said condition detecting means; and, said control means being operable to indicate impending alarm in response to said fault condition associated with the degree of the selected condition being detected deviating from normal range in said first sense and to indicate detection insensitivity in response to said fault condition associated with the degree of the selected condition being detected deviating from normal range in said second sense.

15. The invention defined in claim 13 wherein said control means is operable to indicate trouble upon the open circuiting of said bus means.

16. The invention defined in claim 13, wherein:

said apparatus is for detecting the presence of smoke and combustion products in the atmosphere thereby to detect the occurrence of fire; and, each of said condition detecting means includes an ion chamber.

17. A method of detecting the change of a selected condition from a normal to an alarm state, comprising:

monitoring the selected condition at a plurality of points throughout a zone and producing a load impedance for each of such points indicative of the degree of the selected condition there detected;

connecting said load impedances as parallel loads; and, sensing changes in the resultant impedance of said parallel loads to detect changes of the selected condition from a normal to an alarm state.

18. In condition detecting apparatus operable to generate a variable signal which is a function of the degree of the selected condition being detected, the improvement comprising:

means for said apparatus receiving operating power including a pair of terminals through which said operating power is supplied;

means for producing when said variable signal is within a predetermined range indicative of condition normal a first impedance across said pair of terminals which appears as the condition normal load impedance of said condition detecting apparatus;

means for producing when said variable signal moves out of said predetermined normal range in a first sense indicative of increase of the degree of the selected condition towards an alarm state a second impedance across said pair of terminals which appears as the impending alarm load impedance of said condition detecting apparatus;

means for producing when said variable signal moves out of said predetermined normal range in said first sense by a predetermined amount exceeding the impending alarm level and indicative of the increase of the degree of the selected condition to an alarm state a third impedance across said pair of terminals which appears as the alarm load impedance of said condition detecting apparatus; and means for producing when said variable signal moves out of said predetermined normal range in a second sense opposite from said first sense a fourth impedance across said pair of terminals which appears as the detection insensitivity load impedance of said condition detecting apparatus.

19. The invention defined in claim 18, wherein:

said first impedance has a fixed first magnitude;

said third impedance has a fixed second magnitude different from said first magnitude;

said second impedance is pulsating and varies at a first predetermined frequency between said first and second magnitudes; and said fourth impedance is also pulsating and varies at a second predetermined frequency between said first and second magnitudes, said second predetermined frequency being perceptibly different from said first predetermined frequency.

20. The invention defined in claim 19, wherein:

each of said condition detecting means includes a light emitting diode;

each of said condition detecting means is operable to flash said light emitting diode at said first predetermined frequency whenever said second impedance is being generated to visually indicate impending alarm condition;

each of said condition detecting means is operable to bias said light emitting diode on whenever said third impedance is being generated to visually indicate alarm condition; and, each of said condition detecting means is operable to flash said light emitting diode at said second predetermined frequency whenever said fourth impedance is being generated to visually indicate insensitivity of said condition detecting means.

21. The invention defined in claim 18, wherein each of said condition detecting means includes:

means for sensing the degree of said condition and generating a first electrical signal having a magnitude proportional thereto;

means for generating a second electrical signal as a reference the magnitude of which is proportional to the level of power being received from said control means;

means for generating said variable signal as a function of said first and second electrical signals, said variable signal generating means being responsive to said first and second electrical signals to generate said variable signal as an electrical signal having a magnitude proportional to the difference in magnitudes of said first and second signals, said variable signal being within said predetermined range indicative of condition normal whenever the power received from said control means is at substantially normal level and the degree of the selected condition being detected is in a normal state, said variable signal changing in said first sense in response to changes occurring in the magnitude of said first electrical signal as a result of increase in the degree of the selected condition towards an alarm state and in said second sense whenever the sensitivity of said condition detecting means lessens;

oscillator means responsive to said variable signal for generating whenever said variable signal moves out of said predetermined normal range in said first sense a series of pulses at a first predetermined frequency to indicate impending alarm, said oscillator means also being operable to generate whenever said variable signal moves out of said predetermined normal range in said second sense a series of pulses at a second predetermined frequency to indicate insensitivity of said condition detecting means, said second predetermined frequency being perceptibly different than said first predetermined frequency;

light emitting diode means connected to be driven by said oscillator means at said first and second predetermined frequencies for providing visual indications of impending alarm and insensitivity of said condition detecting means; and, circuit means responsive to said variable signal for latching said light emitting diode means on whenever said variable signal moves out of said predetermined normal range in said first sense by a predetermined amount exceeding the impending alarm level and indicative of the increase of the selected condition to an alarm state to provide a visual indication of alarm.

22. The invention defined in claim 21, wherein said condition detecting apparatus is for detecting the presence of smoke and combustion products in the atmosphere thereby to detect the occurrence of fire and includes an ion chamber.

* * * * *